US006461673B1

(12) United States Patent
Vaz

(10) Patent No.: US 6,461,673 B1
(45) Date of Patent: Oct. 8, 2002

(54) PROTECTIVE BOOT AND SOLE STRUCTURE

(75) Inventor: Guy Andrew Vaz, Singapore (SG)

(73) Assignee: BFR Holdings Limited, Georgetown (KY)

( * ) Notice: Subject to any disclaimer, the term of this patent is extended or adjusted under 35 U.S.C. 154(b) by 0 days.

(21) Appl. No.: 09/633,955

(22) Filed: Aug. 7, 2000

Related U.S. Application Data

(62) Division of application No. 09/470,522, filed on Dec. 22, 1999.

(30) Foreign Application Priority Data

Dec. 29, 1998 (SG) ..... 9804838

(51) Int. Cl.[7] ..... B05D 3/02; B05D 1/36; B05D 1/18; B05D 3/12

(52) U.S. Cl. ..... 427/228; 427/227; 427/455; 427/384; 427/365; 427/404; 427/407.1; 427/431

(58) Field of Search ..... 427/455, 227, 427/228, 384, 365, 404, 407.1, 430.1, 431

(56) References Cited

U.S. PATENT DOCUMENTS

| | | | | |
|---|---|---|---|---|
| 1,685,538 A | | 9/1928 | Glidden et al. | |
| 1,701,611 A | | 2/1929 | Glidden et al. | |
| 3,461,575 A | | 8/1969 | Tead et al. | |
| 3,772,115 A | * | 11/1973 | Carlson et al. | 156/148 |
| 3,845,576 A | | 11/1974 | Howland, Jr. | |
| 3,849,174 A | * | 11/1974 | Ancker | 117/65.2 |
| 3,852,895 A | | 12/1974 | Funck | |
| 3,903,557 A | | 9/1975 | Howland, Jr. | |

(List continued on next page.)

FOREIGN PATENT DOCUMENTS

| | | |
|---|---|---|
| AT | 388 852 B | 2/1989 |
| DE | 22 16 439 A | 10/1973 |
| DE | 26 15 558 A1 | 10/1976 |
| DE | 30 27 601 A1 | 2/1982 |
| DE | 33 21 889 A1 | 12/1983 |
| GB | 1 554 225 | 5/1976 |
| GB | 2 191 384 A | 12/1987 |
| GB | 2 250 416 A | 6/1992 |
| GB | 2 264 221 A | 8/1993 |
| WO | WO 96/03277 | 2/1996 |
| WO | WO 96/26655 | 9/1996 |
| WO | 96/26655 | 9/1996 |
| WO | 97/04675 | 2/1997 |
| WO | WO 97/04675 | 2/1997 |
| WO | 97/43919 | 11/1997 |
| WO | WO 97/43919 | 11/1997 |

*Primary Examiner*—Michael Barr
(74) *Attorney, Agent, or Firm*—Ladas & Parry

(57) ABSTRACT

A sole for a boot and the boot incorporating the sole. The sole provides the wearer of the boot with a level of protection from explosive devices triggered by the wearer stepping on or near the explosive device. The sole includes at least one layer of corrugated blast-resistant material. The corrugations provide channels that effectively channel blast gases generated by the explosion of the explosive device sidewardly and so away from the foot of the wearer of the boot. The sole further includes layers of blast-resistant material and a cocoon of material is also provided throughout the upper of the boot to provide a level of protection to the remainder of the wearer's foot.

20 Claims, 4 Drawing Sheets

U.S. PATENT DOCUMENTS

| | | | | | |
|---|---|---|---|---|---|
| 4,155,180 | A | | 5/1979 | Phillips | |
| 4,526,828 | A | | 7/1985 | Fogt et al. | |
| 4,649,586 | A | | 3/1987 | Wu | |
| 4,774,954 | A | | 10/1988 | Ibrahim | |
| 4,805,319 | A | | 2/1989 | Tonkel | 36/30 R |
| 4,858,338 | A | | 8/1989 | Schmid | |
| 4,862,606 | A | | 9/1989 | Siskind et al. | |
| 5,003,709 | A | | 4/1991 | Okayasu et al. | |
| 5,172,493 | A | | 12/1992 | Diaz | |
| 5,251,386 | A | | 10/1993 | Diaz | |
| 5,272,822 | A | | 12/1993 | Diaz | |
| 5,277,966 | A | | 1/1994 | Nakayama et al. | |
| 5,285,583 | A | | 2/1994 | Aleven | |
| 5,319,866 | A | | 6/1994 | Foley et al. | |
| 5,390,430 | A | | 2/1995 | Fitchmun et al. | |
| 5,401,564 | A | | 3/1995 | Lee et al. | |
| 5,406,723 | A | | 4/1995 | Okajima | |
| 5,433,998 | A | * | 7/1995 | Curzio et al. | 428/260 |
| 5,435,889 | A | * | 7/1995 | Dietrich | 216/63 |
| 5,445,693 | A | * | 8/1995 | Vane | 156/93 |
| 5,538,781 | A | | 7/1996 | Rao et al. | |
| 5,720,118 | A | | 2/1998 | Mayer et al. | 36/30 R |
| 5,804,757 | A | | 9/1998 | Wynne | |
| 5,832,634 | A | | 11/1998 | Wong | |
| 5,843,851 | A | | 12/1998 | Cochran | |
| 5,926,977 | A | | 7/1999 | Sanders | 36/84 |
| 5,992,056 | A | | 11/1999 | Lohrmann | 36/75 R |

* cited by examiner

PROTECTIVE BOOT AND SOLE STRUCTURE

This is a divisional of co-pending U.S. application Ser. No. 09/470,522 filed on Dec. 22, 1999.

FIELD OF THE INVENTION

The present invention relates to footwear and in particular to a boot that is constructed to protect the foot of a wearer from serious damage resulting from the impact of a projectile and/or explosions from anti-personnel mines inadvertently detonated by the boot wearer. The present invention is also directed to a material that can be used, in one application, in the footwear described in the present application.

BACKGROUND TO THE INVENTION

Anti-personnel mines which are designed to explode as a person steps on or near the mine represent a common and serious problem for any troops deployed either on a conventional battle field or involved in guerilla warfare.

The amount of explosive present in a mine will dictate whether the mine on exploding maims or kills the person triggering the mine. For those devices designed simply to maim, protective footwear can play a role in lessening the likelihood of serious injury. Such footwear can also have a role in lessening the damage caused by the impact of projectiles such as bullets and shrapnel.

The present inventor has developed boots, and in particular boot soles, that can afford a level of protection to the foot of a person triggering an anti-personnel mine containing reasonable quantities of explosive while still providing the wearer with sufficient toe-to-heel flexion in the boot to allow activities such as running, jumping and climbing (see International Application Nos PCT/SG96/00001, PCT/SG96/00008 and PCT/SG97/00010).

The present invention is directed to a new type of boot structure that offers an improved level of protection to wearers that may inadvertently trigger an anti-personnel mine.

SUMMARY OF THE INVENTION

According to a first aspect, the present invention comprises a sole for an article of footwear, the sole including at least one corrugated layer of a substantially blast and/or fragment resistant material.

In one embodiment, the corrugated layer is only present in the heel of the sole. In another embodiment, the corrugated layer can be present in the portion of the sole extending forwardly from the heel or the fore portion. In a still further embodiment, the corrugated layer can extend across a substantial portion of or the entire sole. The corrugated layer is preferably formed in the sole such that the corrugations extend transversely to the longitudinal axis of the sole. In a further preferred embodiment, each of the corrugations are preferably at about a right angle to the longitudinal axis of the sole.

The corrugated layer can be formed in the sole with a planar layer formed from the blast and/or fragment resistant material disposed on the upper and/or lower sides of the corrugated layer. Preferably, the planar layer can be disposed on the upper and/or lower sides of the corrugated layer such that it meets the peaks of some or each of the corrugations of the corrugated layer. The planar layer on the upper and/or lower sides of the corrugated layer, can be formed integrally with the corrugated layer or brought into fixed attachment with the corrugated layer. Where a planar layer is disposed on at least one of the upper or lower sides of the corrugated layer, at least a first set of a plurality of channels are formed in the sole. The present inventor has determined that these channels are surprisingly effective in channelling blast gases, generated when a mine is triggered, laterally away from the foot of the wearer.

In one embodiment of the invention, the sole can have at least one corrugated layer in both the heel and the fore portion extending forwardly from the heel, with the respective corrugated layers in the heel and fore portions being formed from different materials.

The corrugated layer and planar layers disposed on the upper or lower sides of the corrugated layer can be formed from a metal-matrix composite material. The composite can be formed from woven or chopped graphite, a ceramic material or a combination of such materials. In a preferred embodiment, it is formed from woven graphite (ie carbon fibre) of the type 3K TOW, 380 g/m$^2$, M60/T300 that has been impregnated with a polymer containing a metal powder. The polymer can comprise either a polymer solution or molten polymer, with the metal being a metal alloy. The metal alloy can constitute at least 20% w/w of the polymer. Examples of the metal powder include aluminium alloys, such as an alloy of aluminium, nickel and molybdenum.

To form the composite, the woven graphite can be passed through a drier (such as an electric furnace) and then through a bath of molten alloy which fully wets the fabric. In a preferred embodiment, the molten alloy is a molten aluminium alloy of aluminium, nickel and molybdenum. As the woven graphite passes through the molten alloy, the polymer carburises between 500° C. and 600° C. and a chemical bond is created between the graphite fibres and the metal. The metal matrix composite is then passed through a set of rollers that are capable of exerting about 35 to 40 tons of compressive force and which squeeze out all excess metal alloy from the composite. The result is a composite material impregnated with metal.

The metal powder added to the polymer impregnating the woven graphite can also include titanium and nickel alloys. In this case, up to 50% w/w of the metal powder can be added to the molten polymer. By using such metal powders, the step of passing the impregnated woven graphite through the bath of molten alloy can be discarded. Instead, the woven graphite can be simply passed through the drier and then through the rollers.

Other metals, such as titanium, beryllium and metal alloys of various types can then be applied to the material to provide excellent bonding of the material. The other metals can also be applied by processes such as plasma spraying or hot sheet pressing.

In an alternative embodiment, the corrugated layer and planar layers disposed on the upper and/or lower sides of the corrugated layer can be formed from a polymer impregnated or an epoxy resin impregnated composite.

In a preferred embodiment of the invention, the sole includes a heel plate including a first upper portion of one or more, and preferably three, layers of woven aramid fibre. The woven aramid layers can each be formed from 280 g/m$^2$ woven aramid. During the manufacturing process for the sole, the layers of woven aramid fibre are preferably held together by a porous coat of adhesive, such as hot melt polyurethane adhesive. In the heel plate, the corrugated layer preferably does not extend outwardly to the periphery of the first upper portion of one or more layers of woven aramid fibre. Rather, it preferably extends to a position inwardly from the periphery with the distance or gap between the periphery of the inner portion and the corrugated layer being substantially identical about the periphery of the heel plate. In one particularly preferred embodiment, the distance between the periphery of the first upper portion and the periphery of the corrugated layer is about 7 mm. As an example only, the material forming the corrugated layer in the heel portion can have a thickness of about 0.38 mm, with the corrugations having a height of about 4.5 mm and a peak to peak spacing of about 2 mm.

In a further embodiment, the sole includes a flexible fore plate disposed in the fore portion of the sole. The fore plate preferably includes a first upper portion of one or more, and preferably three, layers of woven aramid fibre. Again, the woven aramid layers can each be formed from 280 g/m$^2$ woven aramid. During the manufacturing process for the sole, the layers of woven aramid in the first upper portion of the fore plate are also preferably held together by a porous coat of adhesive, such as hot melt polyurethane adhesive.

In the case of the fore plate, the corrugated layer is preferably positioned in the fore plate immediately below the first upper portion and comprises a layer of corrugated polymer impregnated composite. The corrugated layer preferably does not extend to the periphery of the first upper portion of one or more layers of woven aramid fibre. Rather, it preferably extends to a position inwardly from the periphery with the distance or gap between the periphery of the first upper portion and the periphery of the corrugated layer being substantially identical about the periphery of the fore plate. In one particularly preferred embodiment, the distance between the periphery of the first upper portion and the periphery of the corrugated layer is about 7 mm. The polymer impregnated composite can comprise two layers of woven aramid and, more preferably, two layers of 280 g/m$^2$ scoured Twaron. To form this composite, the woven fabric is impregnated with a polymer solution. The fabric is then preferably passed through a drier, and then through a bath of molten nylon which wets the fabric completely. Ultrasonic vibrators can be used to vibrate the molten nylon as the fabric is passed therethrough. The composite is then passed between two rollers that exert at least several tons of compression on the fabric to squeeze out excess polymer from the composite. It is preferred that the resulting polymer impregnated composite contains less than 30% w/w of polymer.

The corrugated impregnated polymer composite layer in the fore plate is preferably adhered with epoxy resin to the first upper portion of one or more layers of woven aramid. In addition, the composite layer can be stitched to the first upper portion. As an example only, the material forming the corrugated layer in the fore plate can have a wall thickness of about 0.4 mm, with the corrugations having a height of about 4.5 mm and a peak to peak spacing of about 2 m.

The sole according to the present invention is adapted to be part of an article of footwear, such as a boot worn by infantry troops in combat zones.

According to a second aspect, the present invention comprises a blast-resistant sole for an article of footwear adapted to offer a level of protection to the foot of the wearer of the footwear if the wearer inadvertently triggers an explosive device, the sole having a longitudinal axis and including a plurality of channels extending transversely to the longitudinal axis, each of the channels being adapted to channel blast gases, generated when the explosive device is triggered, laterally away from the foot of the wearer.

In this second aspect, the plurality of channels can be formed by the provision of at least one corrugated layer of blast-resistant material as described herein.

In each of the above aspects, the boot preferably further includes a cocoon of substantially blast-resistant material that is incorporated into the boot. The cocoon is preferably adapted to substantially or entirely surround the foot of a wearer of the boot. The cocoon can be integrated within the upper of the boot or comprise the upper. In a preferred embodiment, the upper is preferably formed from a natural or synthetic leather outer layer and an inner vamp layer of leather or cotton between which the cocoon is positioned. The cocoon is preferably formed from one or more layers of blast-resistant material. In one embodiment, the cocoon can include at least two layers of woven aramid. The woven aramid can be 450 g/m$^2$ ZyPhir material made for ZyPhir Research by Akzo-Nobel Twaron. The layers of woven aramid of the cocoon can also be stitched together with aramid fibre (such as ZyPhir 210 thread) to form an integrated protective and supportive cocoon. The layers of woven aramid are also preferably bonded with polyurethane hot melt adhesive that is applied as a porous coating. The result preferably is a material for the cocoon that is water-resistant yet breathable. In a specific application, a soft and pliable polyurethane hot melt is applied as a coating between the at least two layers of aramid. The polyurethane hot melt can be applied in a layer of about 0.05 mm. This embodiment of the boot has particular application in cold climates but could be used in warmer conditions.

In another embodiment, the cocoon can comprise a sandwich of layers of woven ceramic fibres or woven ceramic/glass-ceramic composite fibres and aramid fibres.

The sole according to the present invention is preferably stitched about its periphery to the cocoon. Where there is a distance or gap between the periphery of the corrugated layer and the periphery of the inner portion, the stitching between the sole and the cocoon preferably is made outside the periphery of the corrugated layer.

The sole according to the present invention preferably also includes an additional layer of blast-resistant material disposed between the lower surface of the cocoon and the at least one corrugated blast-resistant layer included in the sole. The additional layer is preferably comprised of a plurality of layers of woven aramid fibre. In a particularly preferred embodiment, the additional layer can comprise at least fifteen layers of woven aramid fibre. The woven aramid fibre can comprise 200 g/m$^2$ ZyPhir material that is made for ZyPhir Research by Akzo-Nobel Twaron. Preferably, each layer of woven aramid is bonded together with a fine spray of hot melt polyurethane adhesive. The polyurethane adhesive is preferably applied as a porous coating of about 5g of polyurethane per square metre of woven aramid.

The sole according to the present invention preferably includes a still further layer of blast-resistant material disposed between the additional layer and the at least one corrugated blast-resistant layer included in the sole. The still further layer can be formed from at least one layer of woven aramid and at least one layer of woven ceramic fibre. It is particularly preferred that a woven ceramic fibre layer is the outermost or bottommost layer of the still further layer of blast-resistant material. It is further preferred that the still further layer includes a plurality of layers of woven aramid and woven ceramic fibre, with the aramid and ceramic fibre layers being layered in alternating sequence. Again, it is preferred that the ceramic fibre layer be the outermost or bottommost layer of the still further layer. In one embodiment, as an example only, the still further layer can include two layers of woven aramid fibre interleaved with two layers of woven ceramic fibre, again with one of the woven ceramic layers being the outermost or bottommost layer. The woven aramid fibre can be formed from 280 g/m$^2$ aramid in this example. In still other embodiments, some or each of the layers of woven ceramic fibre can be replaced with woven ceramic/glass-ceramic composite fibres.

The sole preferably includes an outermost ground-engaging layer. This layer is preferably formed from rubber or polyurethanie. In the case of the rubber sole it can be vulcanised onto the boot. The ground-engaging layer can be formed in at least two layers, an outermost layer and an inner layer. The outermost layer can comprise a nitrile rubber and the inner layer can be formed of a foam rubber. The nitrile rubber can have a specific gravity of 1.6 and a Shore A hardness of 85. The nitrile rubber layer can be about 3 mm. The foam rubber layer can have a specific gravity of 0.6 and a Shore A hardness of 40. The foam rubber layer provides a greater level of comfort to the wearer of the footwear than if the outermost layer was formed entirely of nitrile rubber as described.

BRIEF DESCRIPTION OF THE DRAWINGS way of example only, a preferred embodiment of the invention is now described with reference to the accompanying drawings, in which.

Figure 1:
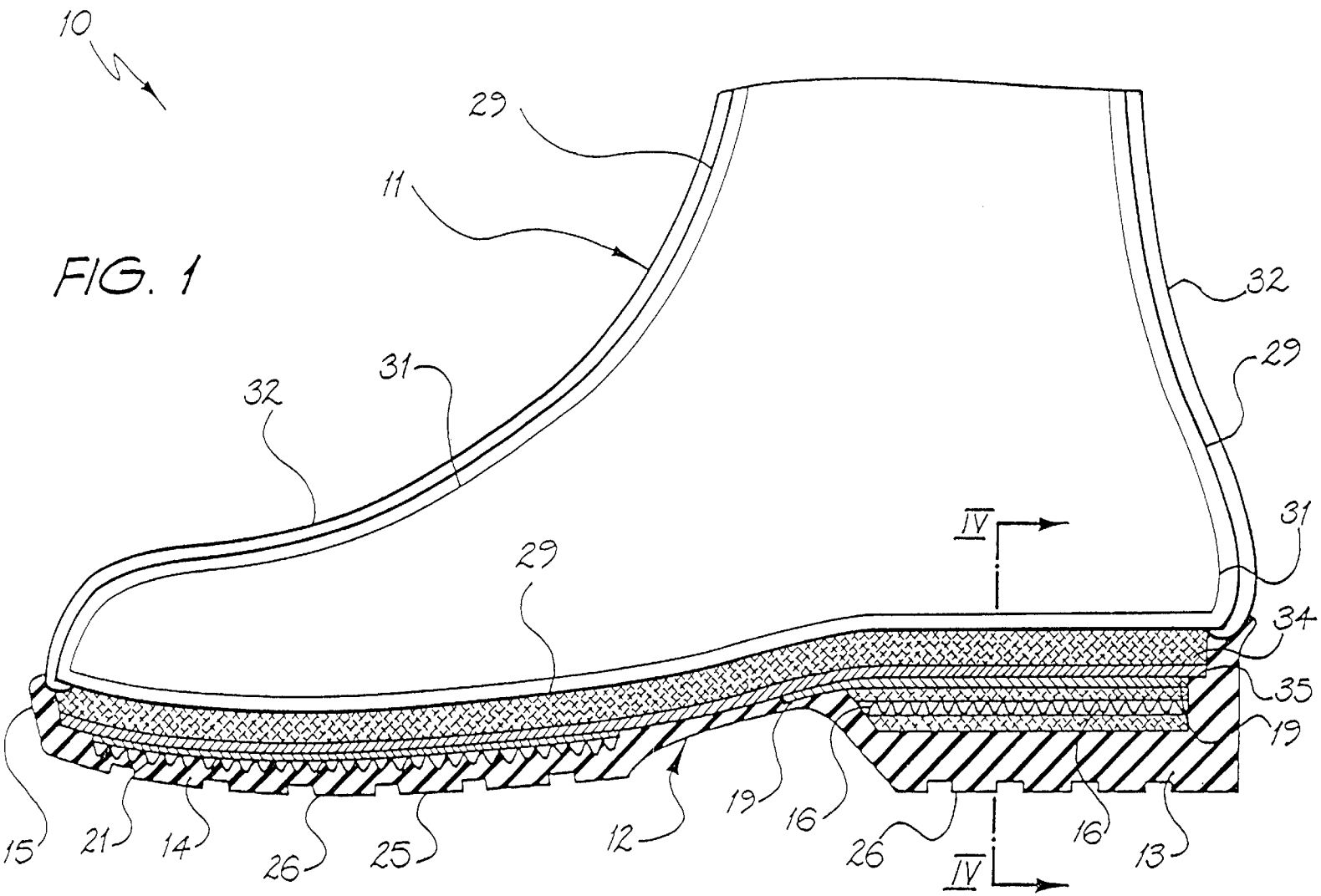
FIG. 1 is a simplified cross-sectional view of a boot having a sole according to the present invention.
Figure 2:
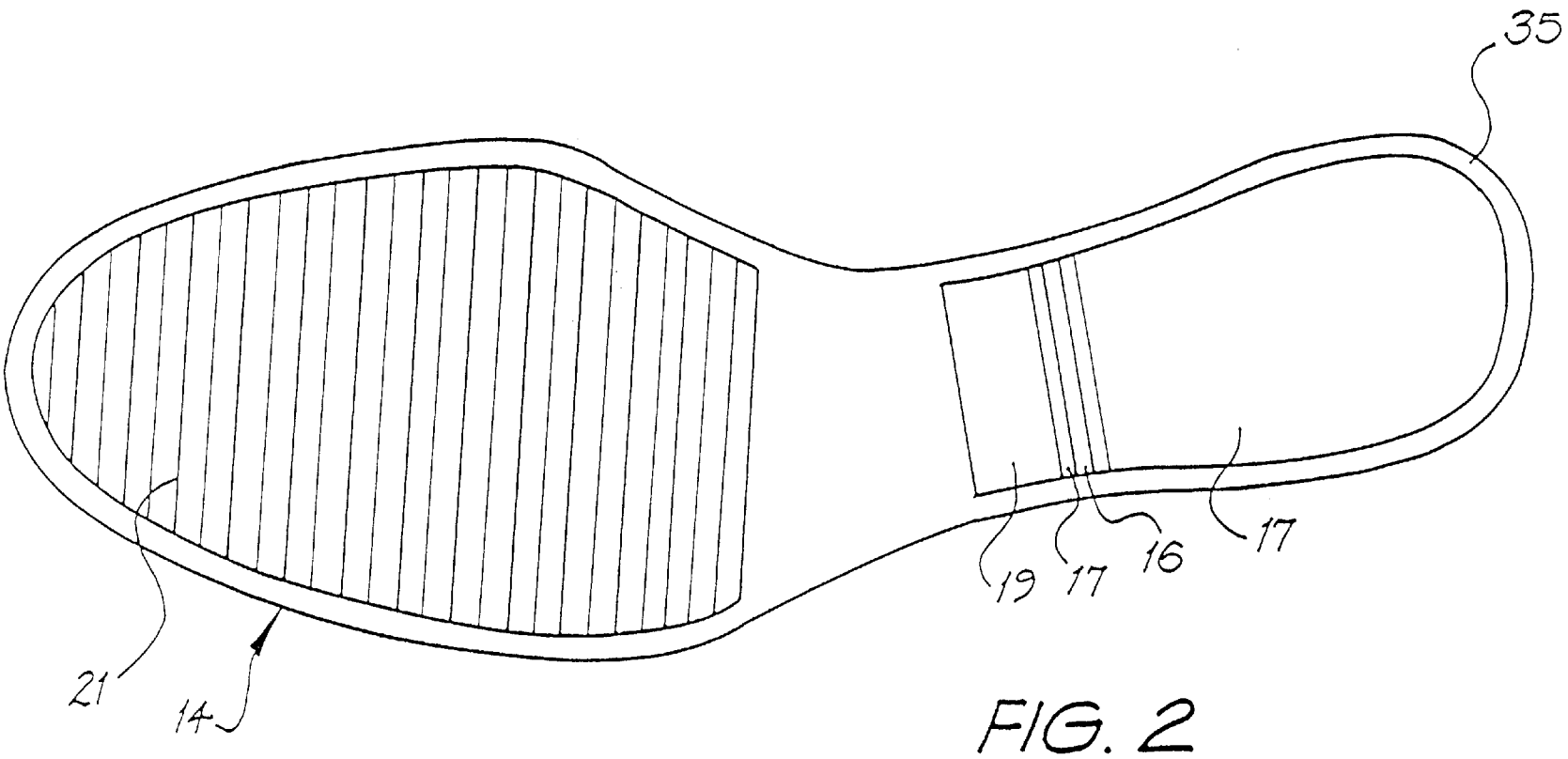
FIG. 2 is an inverse plan view of the fore plate and blast shield used in the sole according to the present invention.
Figure 3:
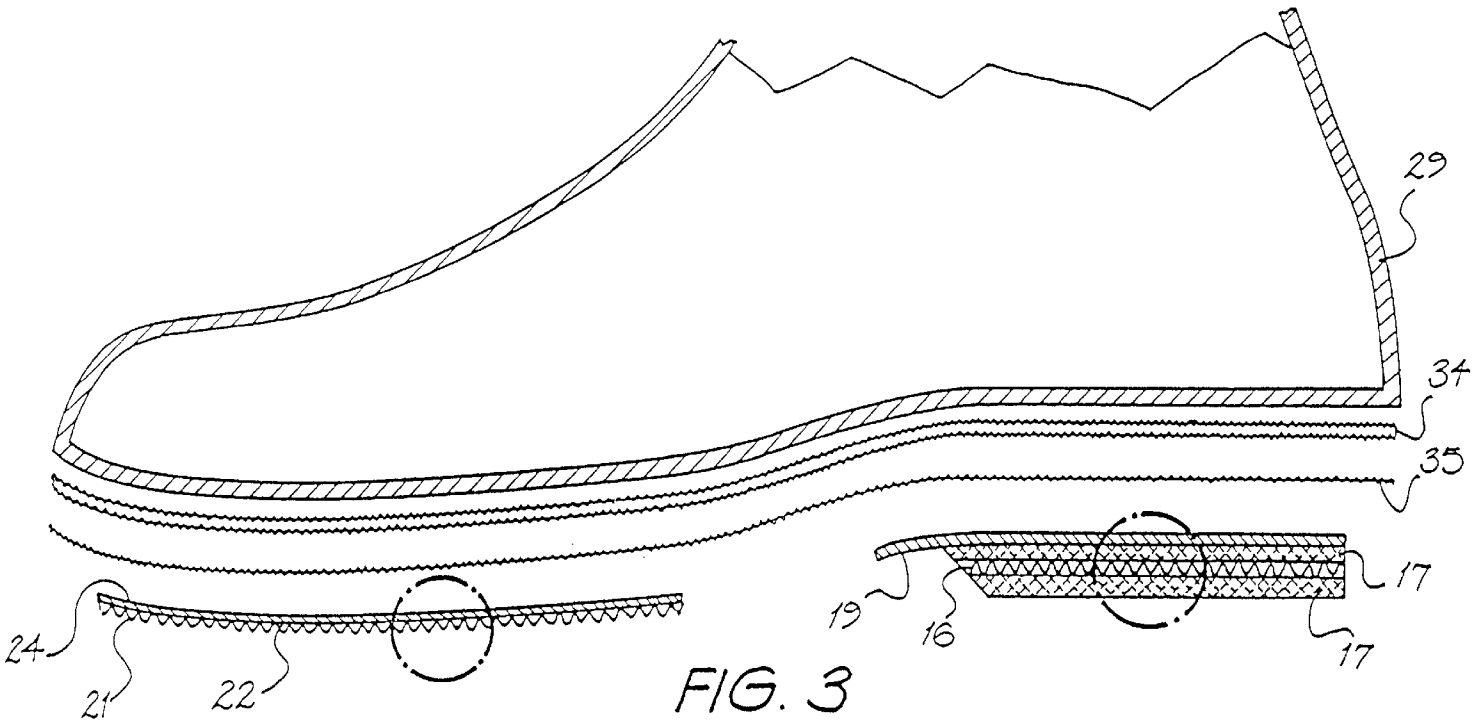
FIG. 3 is an exploded vertical cross-sectional view of components of the boot and sole depicted in FIG. 1.
Figure 3B:
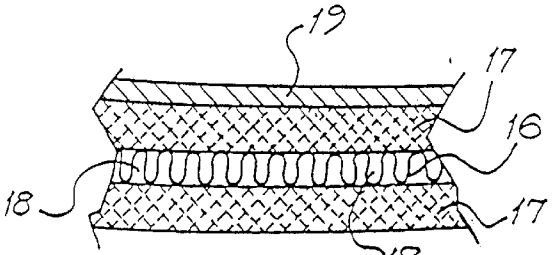
Figure 3A:
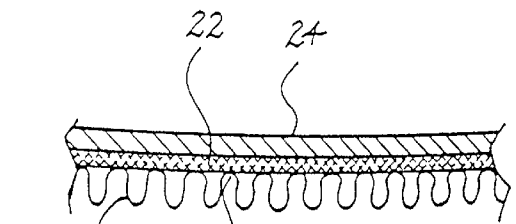
Figure 4:
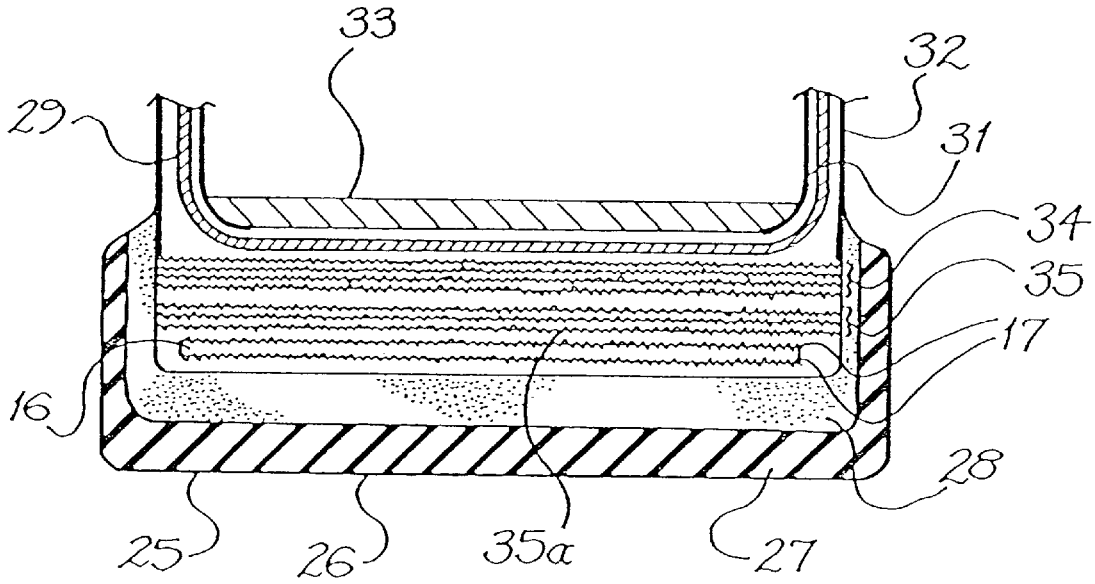

FIG. 3*a* is an enlarged view of the corrugated layer in the fore plate of the sole according to the present invention;

FIG. 3*b* is an enlarged view of the corrugated layer in the heel of the sole according to the present invention; and FIG. 4 is a cross-sectional view of the heel of the sole along line IV—IV of FIG. 1 according to the present invention.

PREFERRED MODE OF CARRYING OUT THE INVENTION

A boot having the features of the present invention is generally depicted as 10 in FIG. 1. Explosive devices that are hidden in the ground and adapted to be exploded by the weight of a person walking on or near the ground where the device is buried are generally called mines. The damage that can be caused by a mine is dependent on the type and quantity of the explosive used in the mine. While mines can obviously kill, the purpose of many mines is to only maim the person who is unfortunate to trigger the device. The boot having the features of the present invention is designed to be worn by infantry soldiers or others moving through areas where mines are known or possibly hidden. While no form of wearable protection can protect against all devices that are designed to cause large explosions, the present invention does offer a level of protection that is designed to protect the foot of the soldier from serious damage, such as loss of a foot, if the soldier triggers a mine having a type or quantity of explosive that would maim a person wearing normal footwear.

The boot 10 has a substantially standard shaped upper 11 adapted to enclose the foot and ankle of a wearer and a sole 12. The sole 12 comprises a heel 13 and a fore plate region 14 that extends from a position distal the heel 13 to the toe 15 of the boot 10.

The heel 13 includes at least one corrugated layer of metal-matrix composite material 16 that extends in a plane throughout at least a majority of the heel 13. Disposed immediately above and below the corrugated layer 16 is at least one layer of planar metal-matrix composite 17. The combination of the corrugations in the corrugated layer 16 and the respective planar layers 17 defines a plurality of channels 18 that extend transversely across the heel 13. The channels 18 serve to channel laterally blast gases generated by the explosion of a mine beneath the boot 10 sidewardly and so serve to provide a level of protection to the foot of the wearer in the boot 10 above the corrugated layer 16.

In the depicted embodiment, the metal-matrix composite is formed from woven graphite (preferably, of the type 3K TOW, 380 g/m$^2$, M60/T300) impregnated with a polymer containing a metal powder of an alloy including aluminium, nickel and molybdenum.

The composite is formed in a method including the steps of:

- impregnating the graphite with the polymer containing the metal alloy powder;
- drying the graphite in a drier;
- passing the graphite through a molten bath of an aluminium/nickel/molybdenum alloy that is at a temperature to carburise the polymer; and
- exerting a pressure on the composite to remove the excess metal alloy therefrom.

The step of exerting pressure on the composite is achieved by passing the composite through a set of rollers that are capable of exerting about 35 to 40 tons on the composite.

It will be realised that corrugated layers of other materials could be utilised in the sole of the present invention. For example, a polymer impregnated composite or an epoxy impregnated composite could be utilised in certain situations as the corrugated layer in the heel of the sole.

Disposed above the corrugated layer 16 in the heel 13 is an upper layer 19 of blast-resistant material which in the depicted embodiment comprises three layers of woven aramid fibre that extend substantially to the periphery of the heel 13. In the depicted embodiment, the three layers of aramid are each formed from 280 g/m$^2$ woven aramid held together by a porous coat of hot melt polyurethane adhesive. In the depicted embodiment, the corrugated layer 16 does not extend laterally as far as the upper layer 19. Rather. a gap is left about the entire periphery of the heel 13.

The fore plate 14 is resiliently flexible and includes at least one corrugated layer of polymer impregnated composite material 21 that extends throughout at least a majority of the fore plate 14. Disposed immediately above the corrugated layer 21 is at least one layer of non-corrugated polymer impregnated composite 22. The combination of the corrugations in the corrugated layer 21 and the non-corrugated layer 22 defines a plurality of channels 23 that extend transversely across the fore plate 14. The channels 23 serve to channel laterally blast gases generated by the explosion of a mine beneath the boot 10 sidewardly and so serve to provide a level of protection to the foot of the wearer in the boot 10 above the corrugated layer 21.

Disposed above the corrugated layer 21 and non-corrugated layer 22 in the fore plate 14 is an upper layer 24 of blast-resistant material which in the depicted embodiment comprises three layers of woven aramid fibre that extend substantially to the periphery of the fore plate 14. In the depicted embodiment, the three layers of aramid are each formed from 280 g/m$^2$ woven aramid held together by a porous coat of hot melt polyurethane adhesive. In the depicted embodiment, the corrugated layer 21 does not extend laterally as far as the upper layer 24. Rather, a gap is left about the entire periphery of the fore plate 14. While the corrugated layer in the fore plate 14 is adhered to the upper layer 24 using an epoxy adhesive, stitching can also be used to strengthen the adherence of the layers 21, 22 and 24 together in the fore plate 14.

The sole 13 further includes a ground engaging layer 25. The layer 25 in the depicted embodiment is formed from rubber and has been vulcanised to the remainder of the sole. The layer 25 has a tread 26 that allows the wearer to walk across ground surfaces likely to be encountered by the wearer. In the depicted embodiment, and as is depicted in FIG. 4, the layer 25 includes an outer layer 27 and an inner layer 28. The outer layer 27 is formed from a nitrile rubber while the inner layer 28 is formed from a softer foam rubber. In the depicted embodiment, the nitrite rubber has a specific gravity of 1.6, a Shore A hardness of 85, and a thickness of about 3 mm. The foam rubber, which provides a greater level of comfort to the wearer, has a specific gravity of 0.6 and a Shore A hardness of 40.

The boot 10 also includes a cocoon 29 of substantially blast-resistant material that is incorporated into the boot 10 and which is adapted to entirely surround the foot of a wearer of the boot 10. In the depicted embodiment, the cocoon 29 is formed from two layers of woven aramid fibre (see FIG. 4) that extend across the sole 13 of the boot and also up within the upper 11 of the boot 10. As is depicted in FIG. 1, the cocoon 29 is disposed between a cotton vamp 31 and the leather outer 32 in the upper 11. As is depicted in FIG. 4, the cocoon extends beneath a known in the art comfort sole liner 33 and the remainder of the sole 13. The layers of woven aramid forming the cocoon 29 are preferably bonded by hot melt polyurethane adhesive and are stitched together using aramid fibre. While not depicted, it can be readily envisaged that the cocoon 29 can include layers of woven ceramic fibres or woven ceramic/glass-ceramic composite fibres and woven aramid fibres.

The cocoon 29 is also stitched to the sole about the periphery of the sole 13 to further increase adherence of the sole 13 to the remainder of the boot 10.

An additional layer 34 of blast-resistant material is also provided in the sole 13. In the depicted embodiment, the additional layer 34 comprises fifteen layers of woven aramid fibre. In FIG. 4, however, only four of the layers are depicted for clarity. It will be envisaged that more or less layers could be utilised if desired. The woven aramid fibre layers are bonded together with a hot melt polyurethane adhesive.

The sole also includes a still further layer 35 of blast-resistant material or a blast shield. The blast shield 35 is, in the depicted embodiment, formed from alternating layers of woven aramid fibre and woven ceramic fibre. In the depicted embodiment, the bottommost layer 35*a* (see FIG. 4) of the blast shield 35 is a layer of woven ceramic fibre. It will be appreciated that in the blast shield 35 that the woven ceramic fibre can be replaced with woven ceramic/glass-ceramic composite fibres in another embodiment of the invention.

The various layers of the sole 13 are preferably supported in a suitable supporting medium, such as polyurethane or rubber. It will be appreciated that suitable adhesives and stitching can be employed to form the entire boot 10 including its sole 13 and cocoon 29. A deflector plate, such as is described in the applicant's international application No PCT/SG97/00010, the contents of which are incorporated herein by reference, can also be incorporated into the sole 13, if desired.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A method for forming a metal matrix composite material, wherein the composite is formed from woven or chopped graphite, the method including the steps of:

impregnating the graphite with a polymer containing a metal powder;

drying the graphite;

passing the graphite through a molten bath of metal alloy that is at a temperature to carburise the polymer and so form the composite material; and exerting pressure on the composite material to remove excess metal alloy therefrom.

2. The method of claim 1 wherein the composite is formed from woven or chopped graphite and a ceramic material.

3. The method of claim 1 wherein the woven graphite is of the type 3K TOW, 380 g/m$^2$, M60/T300.

4. The method of claim 1 wherein the polymer comprises either a polymer solution or molten polymer .

5. The method of claim 1 wherein the metal powder is formed from a metal alloy.

6. The method of claim 5 wherein the metal alloy constitutes at least 20% w/w of the polymer.

7. The method of claim 6 wherein the metal powder is formed from an alloy including one of aluminum, nickel and molybdenum.

8. The method of claim 1 wherein the step of drying the graphite comprises passing the graphite through an electric furnace.

9. The method of claim 1 wherein the molten metal alloy is formed from an alloy including one of aluminum, nickel and molybdenum.

10. The method of claim 1 wherein the step of exerting pressure on the composite material comprises passing the composite through a set of rollers that are capable of exerting about 35 to 40 tons of compression and which squeeze out substantially all excess metal alloy from the composite material.

11. The method of claim 1 wherein a metal is applied to the composite material to provide bonding of said woven or chopped graphite to said metal powder.

12. The method of claim 11 wherein the metal is titanium, beryllium or a metal alloy.

13. The method of claim 12 wherein the metal is applied by plasma spraying or hot sheet pressing.

14. A method for forming a metal matrix composite material, wherein the composite is formed from woven or chopped graphite, the method including the steps of:

impregnating the graphite with a molten polymer containing an alloy powder;

passing the graphite through a molten bath of metal alloy that is at a temperature to carburise the polymer and so form the composite material;

drying the impregnated graphite; and rolling the impregnated graphite in a set of rollers to form a rolled composite material.

15. The method of claim 14 wherein the composite is formed from woven or chopped graphite and a ceramic material.

16. The method of claims 14 wherein the woven graphite is of the type 3K TOW, 380 g/m$^2$, M60/T300.

17. The method of claim 14 wherein the high temperature alloy is a titanium or nickel alloy.

18. The method of claim 17 wherein the metal alloy constitutes up to about 50% w/w of the polymer.

19. The method of claim 14 wherein the step of drying the graphite comprises passing the graphite through an electric furnace.

20. The method of claim 14 wherein the step of exerting pressure on the impregnated graphite comprises passing the graphite through a set of rollers that are capable of exerting about 35 to 40 tons of compression.

* * * * *